US011391024B2

(12) United States Patent
Song et al.

(10) Patent No.: US 11,391,024 B2
(45) Date of Patent: Jul. 19, 2022

(54) MULTI-OUTLET FAUCET SYSTEMS

(71) Applicant: AS America, Inc., Piscataway, NJ (US)

(72) Inventors: Ki Bok Song, Plainview, NY (US); Alison Lyons, Jersey City, NJ (US); Jiekun Qian, Astoria, NY (US); Jean-Jacques L'Henaff, New Canaan, CT (US); Emilie Williams, New York, NY (US)

(73) Assignee: AS America, Inc., Piscataway, NJ (US)

( * ) Notice: Subject to any disclaimer, the term of this patent is extended or adjusted under 35 U.S.C. 154(b) by 228 days.

(21) Appl. No.: 16/770,126

(22) PCT Filed: Dec. 5, 2018

(86) PCT No.: PCT/US2018/063983
§ 371 (c)(1),
(2) Date: Jun. 5, 2020

(87) PCT Pub. No.: WO2019/113158
PCT Pub. Date: Jun. 13, 2019

(65) Prior Publication Data

US 2020/0385963 A1 Dec. 10, 2020

Related U.S. Application Data

(60) Provisional application No. 62/595,884, filed on Dec. 7, 2017.

(51) Int. Cl.
*E03C 1/04* (2006.01)
*E03C 1/05* (2006.01)

(52) U.S. Cl.
CPC ..... *E03C 1/0404* (2013.01); *E03C 1/055* (2013.01); *E03C 2001/0414* (2013.01)

(58) Field of Classification Search
CPC . E03C 1/0404; E03C 1/055; E03C 2001/0414
See application file for complete search history.

(56) References Cited

U.S. PATENT DOCUMENTS 6,220,298 B1 4/2001 Wu
7,090,144 B2 * 8/2006 Gross ..... E03B 9/20 137/625.48

(Continued)

FOREIGN PATENT DOCUMENTS

CN 107131323 A * 9/2017

OTHER PUBLICATIONS

International Search Report dated Mar. 26, 2019 in corresponding International Application No. PCT/US2018/063983 (4 pages).

*Primary Examiner* — Janie M Loeppke
(74) *Attorney, Agent, or Firm* — Tyler A. Stevenson; Anna-lisa L. Gallo

(57) ABSTRACT

A faucet (102) is provided having a faucet body (106) and a faucet head (108), wherein the faucet head (108) comprises a first outlet (110, 112) and a second outlet (110, 112). The faucet is configured such that manual rotation of the faucet head (108) causes the faucet to toggle between a first mode in which fluid is dispensed from the first outlet and a second mode in which fluid is dispensed from the second outlet. Manual rotation of the faucet head may cause one or more valves to be physically/mechanically and/or electronically controlled to control flow of fluid to toggle between the different modes. One fluid outlet may be configured to dispense a first kind of fluid while the other fluid outlet may be configured to dispense a second kind of fluid.

15 Claims, 4 Drawing Sheets

(56) References Cited

U.S. PATENT DOCUMENTS

| | | | | |
|---|---|---|---|---|
| 9,604,857 | B2 * | 3/2017 | Sasaki | B01D 29/01 |
| 2007/0204925 | A1 | 9/2007 | Bolderheij | |

* cited by examiner

MULTI-OUTLET FAUCET SYSTEMS

This relates generally to faucet systems, and more particularly to faucet systems for switching operations between two different fluid outlets of the same faucet.

BACKGROUND

Water filtration systems are becoming more common in households to filter drinking water. These water filtration systems often include their own faucet that is separate from an unfiltered tap water faucet. Having separate faucets takes up valuable counter space.

Although faucets that include multiple water outlets exist, these water outlets are typically located at different distinct fixed positions on the faucet. A user then needs to select which outlet should dispense water (or other fluid) by actuating a switch to select one opening or the other, or by independently operating multiple sets of dedicated controls that correspond to one of the outlets but not the other. For example, these certain faucets often include one or more handles for controlling the tap water outlet but not the filtered water outlet, and one or more separate handles for controlling a filtered water outlet but not a tap water outlet.

Other faucet configurations include a tap water outlet that is disposed on the faucet head, and a filtered water outlet that is disposed on an accessory that attaches to the faucet head. A user actuates a valve to selectively direct tap water to flow directly to the tap water outlet or, alternately, to flow through a filter in the faucet-mounted accessory and then out of the filtered water outlet.

SUMMARY

As discussed above, known solutions for dispensing two different kinds of fluid from a faucet often include providing two fixed fluid outlets on the faucet having respective dedicated controls. Furthermore, known solutions for dispensing tap water and filtered water at the same faucet include attaching a filtered-water accessory to the faucet head to selectively redirect water from the tap water outlet on the faucet through a filter of the accessory and out of an outlet on the accessory.

These known systems and methods have several drawbacks. For example, faucets having separate, dedicated controls configured to each control the flow of fluid to a single faucet outlet may be bulky, complex, and unsightly. Furthermore, a user may not intuitively know which controls correspond to which water outlet, and may need to engage in a trial and error process to determine which controls to use for the desired function. Furthermore, faucet-mounted water-filter accessories may be bulky, unsightly, and inefficient, in that they may be difficult to attach, may become detached from the faucet head, may be limited in filter size thereby limiting filter throughput, and may block easy access to the sink basin when mounted on the faucet head.

For these reasons and for others, there is a need for improved methods for controlling multiple fluid outlets on a single faucet head. Furthermore, there is a need for improved systems and methods for providing and controlling the dispensation of tap water and filtered water from a single faucet head. These improved systems and methods should provide for simple, intuitive, and non-obtrusive controls such that a user may easily and efficiently control multi-outlet faucets; and they should provide for efficient and effective provision of tap and filtered water from faucet heads with high filtered-water throughput and effective, intuitive, and non-obtrusive controls and other system components.

Faucet systems that may address the above needs are provided herein. Particularly, faucet heads for faucets dispensing both tap water and filtered water (or, in some embodiments, any other set of two distinct fluids) from separate outlets are provided. A user may control whether the faucet head dispenses tap water or filtered water by physically actuating the faucet head itself, such as by rotating the faucet head in order to toggle between the two different outputs. In some embodiments, flow rate to either outlet may be controlled by a single handle or knob, while rotation of the faucet head may select between the two outlets, such that only one outlet operates at a time. In some embodiments, the two outlets may be disposed on a rotatable faucet head body, and rotation of the faucet head body may cause rotation of the orientation of the outlets themselves. Thus, the faucet may be configured such that whichever outlet is oriented to face downward is the outlet that is selected for use; an outlet that is not facing downward, such as one that is disposed opposite the other and is facing upward, may in some embodiments not be selected for use and may be shut off in the current orientation. Because the outlet that is selected for use may be dependent on a physical orientation of the faucet head, a user observing the position of the faucet head may quickly and intuitively know which function is selected, and may therefore not have to guess and risk wasting time and dispensing the wrong kind of fluid. Furthermore, because flow of fluid from either outlet may be controlled by a single handle, a user may not have to guess as to what controls correspond to an outlet, and may thereby avoid wasting time and/or dispensing fluid from an incorrect outlet. In some embodiments, rotation or other repositioning or actuation of the faucet head may manually actuate one or more valves controlling flow to one or both of the outlets, while, in some other embodiments, said rotation or actuation may cause one or more electronically controlled valves to be actuated. For example, rotating the faucet head may, in some embodiments, activate one or more sensors that send control signals to one or more electronic valves to cause flow to be enabled and/or disabled to one or more fluid outlets. In some embodiments, electronic sensors may determine a position/orientation of the faucet head, and may accordingly send one or more control signals to one or more electronic valves controlling flow of water to the outlets.

In some embodiments, filtered water may be filtered upstream of the faucet-assembly and/or faucet body, such as by disposing a water filter beneath a sink or behind a wall. In this way, a larger water filter may be used than if a water filter were included in the faucet head or faucet-body itself, and higher filtered-water throughput may be achieved.

Thus, systems, methods, and techniques described herein may be advantageous because they may provide for simple, intuitive, and non-obtrusive controls for multi-outlet faucets such that a user may easily and efficiently control said multi-outlet faucets by toggling between use of one of the outlets and use of the other outlet; and they may provide for efficient and effective provision of tap and filtered water from multi-outlet faucet heads with high filtered water throughput and effective, intuitive, and non-obtrusive system components.

In some embodiments, a faucet is provided, the faucet comprising a faucet body, a faucet head comprising a first fluid outlet and a second fluid outlet; and one or more valves configured to control flow to one or more of the first fluid outlet and the second fluid outlet; wherein the faucet head is configured to be movable between a first position and a second position with respect to the faucet body; and when the faucet head is in the first position, the one or more valves permit flow to the first fluid outlet and do not permit flow to the second fluid outlet; and when the faucet head is in the second position, the one or more valves permit flow to the second fluid outlet and do not permit flow to the first fluid outlet.

In some embodiments, the one or more valves comprise a first valve controlling flow of fluid to the first fluid outlet and a second valve controlling flow of fluid to the second fluid outlet. In some embodiments, the one or more valves comprises a valve controlling flow of fluid to both the first and second outlet.

In some embodiments, the first fluid outlet is configured to dispense a first fluid from a first fluid source and the second fluid outlet is configured to dispense a second fluid from a second fluid source. In some embodiments, the first fluid is unfiltered water and the second fluid is filtered water.

In some embodiments, one or more of the one or more valves are disposed inside the faucet head. In some embodiments, one or more of the one or more valves are disposed at a location fluidly connected to the faucet head and outside the faucet head.

In some embodiments, the first position is a first angular orientation with respect to the faucet body; the second position is a second angular orientation with respect to the faucet body; and the faucet head being configured to be movable between the first position and the second position comprises the faucet head being configured to be rotatable with respect to the faucet body between the first angular orientation and the second angular orientation.

In some embodiments, the faucet head is physically coupled to one or more of the one or more valves such that moving the faucet head to the first position causes the one or more valves to be manually opened to permit flow to the first fluid outlet and to prevent flow to the second fluid outlet.

In some embodiments, the faucet head is physically coupled to one or more of the one or more valves such that moving the faucet head to the second position causes the one or more valves to be manually opened to permit flow to the second fluid outlet and to prevent flow to the first fluid outlet.

In some embodiments, the faucet head is electronically communicatively coupled to one or more of the one or more valves such that moving the faucet head to the first position causes a control signal to be sent to the one or more valves to cause the one or more valves to be electronically opened to permit flow to the first fluid outlet and to prevent flow to the second fluid outlet.

In some embodiments, the faucet head is electronically communicatively coupled to one or more of the one or more valves such that moving the faucet head to the second position causes a control signal to be sent to the one or more valves to cause the one or more valves to be electronically opened to permit flow to the second fluid outlet and to prevent flow to the first fluid outlet.

In some embodiments, the first fluid outlet is facing downward toward a sink when the faucet head is in the first position. In some embodiments, the second fluid outlet is facing downward toward a sink when the faucet head is in the second position.

In some embodiments, the faucet further comprises a handle configured to control flow of fluid to one or more of the first fluid outlet and the second fluid outlet.

In some embodiments, the faucet further comprises a measured-fill control mechanism configured to cause flow of fluid to one or more of the first outlet and the second outlet to start and stop in accordance with a predetermined time interval in order to dispense a target volume of fluid.

In some embodiments, the first fluid outlet is disposed on a first side of the faucet head and the second fluid outlet is disposed on a second side of the faucet head opposite the first side.

In some embodiments, when the faucet head is in the first position, the first fluid outlet is facing in a first direction; and when the faucet head is in the second position, the first fluid outlet is facing in a second direction opposite the first direction.

In some embodiments, when the faucet head is in the first position, the first fluid outlet is located in a first location and oriented in a first orientation with respect to the faucet body; and when the faucet head is in the second position, the second fluid outlet is located in the first location and oriented in the first orientation with respect to the faucet body.

These and other features, aspects, and advantages of the disclosure will be apparent from a reading of the following detailed description together with the accompanying drawings, which are briefly described below. The invention includes any combination of two, three, four, or more of the disclosed embodiments as well as combinations of any two, three, four, or more features or elements set forth in this disclosure, regardless of whether such features or elements are expressly combined in a specific embodiment description herein. This disclosure is intended to be read such that any separable features or elements of the disclosed invention, in any of its various aspects and embodiments, should be viewed as intended to be combinable unless the context clearly dictates otherwise. Other aspects and advantages of the present invention will become apparent from the following.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Described herein are exemplary embodiments of multi-outlet faucet systems and methods that may address the problems and shortcomings of known multi-outlet faucet systems and methods and systems described above, including the problems of inefficient and unintuitive controls and of bulky system components and low throughput. Various embodiments of multi-outlet faucet systems and methods are described below in detail with reference to the figures included herein.

Figure 1:
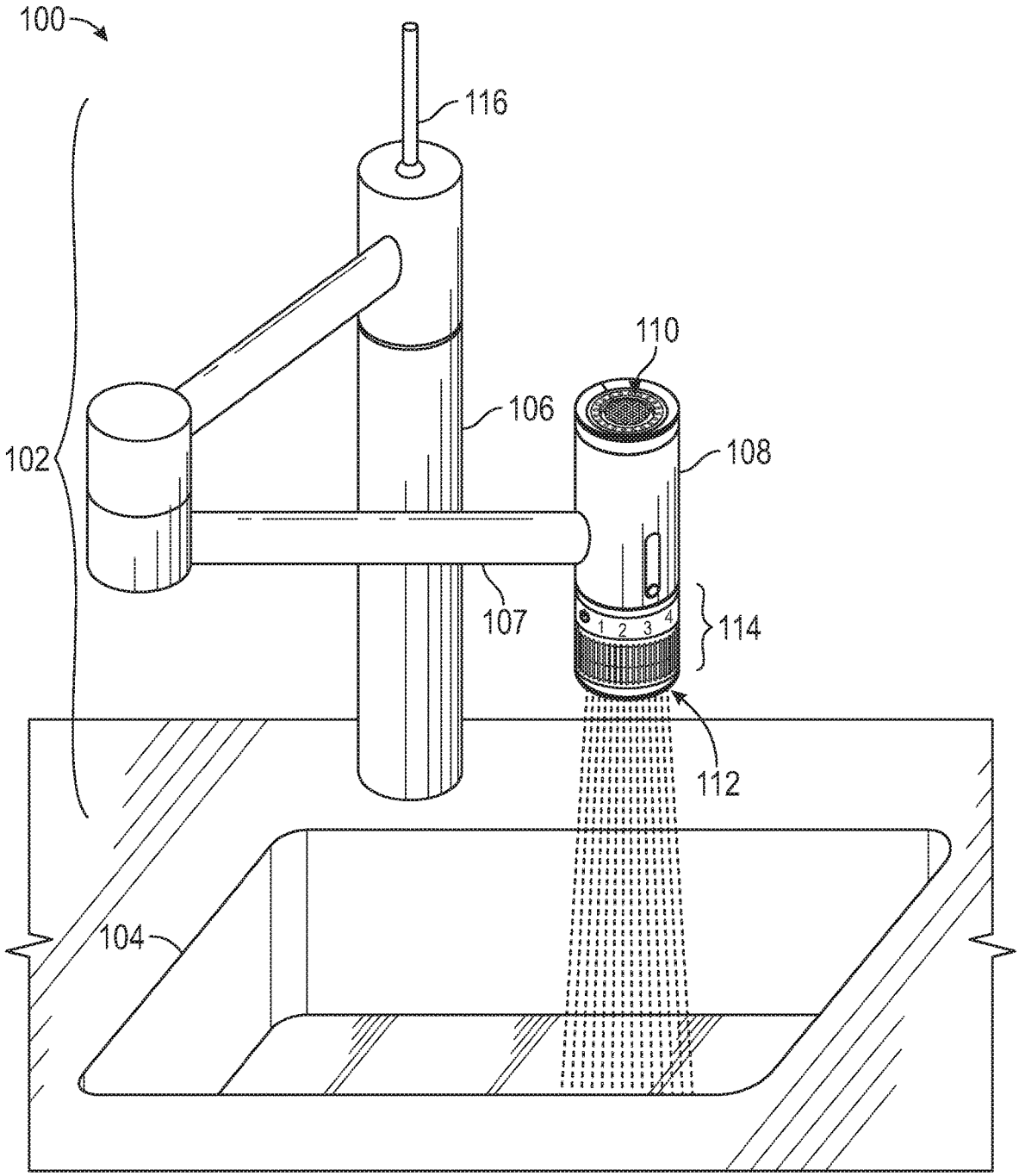
FIG. 1 shows an illustration of a multi-outlet faucet system, in accordance with some embodiments.

FIG. 1 shows multi-outlet faucet system 100, in accordance with some embodiments. As shown, faucet system 100 may comprise faucet 102 disposed over sink 104, and faucet 102 may have faucet body 106 and multi-outlet faucet head 108. As shown, faucet head 108 may be disposed at the end of faucet neck 107, which may connect faucet body 106 to faucet head 108. As described herein, faucet head 108 may be rotatable about the axis of neck 107 to cause system 100 to toggle between dispensing fluid from one opening of faucet head 108 and dispending another fluid from another opening of faucet head 108.

In some embodiments, faucet head 108 may be a multi-outlet faucet head, in that it may have more than one fluid outlet, each outlet configured to dispense one or more fluids into sink 104. In some embodiments, each outlet may be configured to dispense a different kind of fluid. In some embodiments, each outlet may be permanently or selectably fluidly connected to one or more fluid sources, such as a water line of a plumbing system, a fluid reservoir, a canister of fluid, or the like. In some embodiments, the two outlets may be connected to separate fluid sources, while in some embodiments they may be connected to one or more of the same fluid sources. In some embodiments, a multi-outlet faucet head may have fluid outlets configured to dispense tap water, filtered water, purified water, hot water, cold water, carbonated water, liquid soap, cleaning solution, any other fluid suitable for dispensation from a faucet or nozzle, or any combination thereof.

In the embodiments of FIG. 1, faucet head 108 has two outlets, tap water outlet 110 and filtered water outlet 112. In some embodiments, tap water outlet 110 may be fluidly connected to a source for unfiltered water, such as a water line of a plumbing system. In some embodiments, filtered water outlet 112 may be fluidly connected to a source for filtered water, such as a water filter downstream of a source of unfiltered water, or such as a tank or reservoir containing filtered water. In some embodiments, an upstream water filter that provides filtered water to outlet 112 may be disposed beneath sink 104, behind a wall, or otherwise hidden from view of the user and in such a manner as to not be physically obtrusive to a user of faucet system 100. In some embodiments, the conduits fluidly connected to outlets 110 and 112 may fluidly join one another at some point upstream in system 100 (e.g., upstream of a water filter from outlet 112), while in some embodiments the conduits may not join one another at any part of system 100.

In some embodiments, rotation and/or actuation of faucet head 108 may cause system 100 to toggle between a mode in which one outlet of faucet head 108 dispenses fluid and another mode in which a different outlet of faucet head 108 dispenses fluid. For example, in some embodiments, system 100 may be configured such that rotation of faucet head 108 causes system 100 to toggle or switch between different modes in which fluid is dispensed from different outlets. In some embodiments, system 100 may be configured such that only a downward-facing outlet of faucet head 108 may dispense water, so that a user may rotate faucet head 108 by 180 degrees in order to change whether fluid is dispensed from outlet 110 or outlet 112. As shown, in the example of FIG. 1, faucet head 108 may be configured to be manually rotatable by a user about the central axis of neck 107.

In some embodiments, actuation or rotation other than that shown in FIG. 1 may be used to toggle or switch between modes and to cause fluid to be dispensed from a different outlet of a faucet head. For example, rather than two outlets disposed in 180-degree opposition to one another, a faucet head may have three outlets disposed at 120 degree angles from one another, or four outlets disposed at 90 degree angles from one another, and a user may be able to rotate the faucet head such that whichever outlet is downward-facing dispenses a different kind of fluid. (In some embodiments, other numbers of outlets and/or other angular orientations and spacing may be used.) In some embodiments, rather than rotation, translational actuation executed on a faucet head by a user may cause a system to toggle between dispensation modes and dispensation outlets. For example, a faucet may be configured such that a user may push or pull on a faucet head, or slide a faucet head from side to side, in order to deactivate one outlet on the faucet head and activate another. In these embodiments, actuating the faucet head may cause movement of one or more of the outlets of the faucet head, in a similar manner to the way in which rotation of faucet head 108 may cause movement of outlets 110 and 112.

As shown in FIG. 1, system 100 may comprise handle 116, which may be disposed on or near faucet 102 and may be configured to control one or more valves to allow flow to one or more of the outlets on multi-outlet faucet head 108. In some embodiments, a valve cartridge controlled by handle 116 may allow the flow of water from a water line of a plumbing system to continue through faucet body 106 and faucet neck 107 and ultimately to and out of one or more outlets of faucet head 108. For example, handle 116 may be configured such that lifting and/or turning it may actuate one or more valves to control flow of hot water and cold water to outlet 110.

In some embodiments, handle 116 may be configured to control more than one valve, such as when fluid conduits leading to separate outlets of faucet head 108 operate in parallel to one another in system 100. That is, in some embodiments in which fluid conduits supplying different outlets of faucet head 108 run in parallel at or near handle 116, handle 116 may be configured to control operation of one or more separate valves for each of the separate fluid conduits. In some embodiments, handle 116 may be configured to manually/physically operate one or more valves, and in some embodiments handle 116 may be configured to cause one or more valves to be electronically operated in accordance with electronic control signals. In some such embodiments, handle 116 may be configured to activate one or more sensors that send one or more signals to each one of multiple electronic valves controlling flow through one of the fluid conduits of system 100. For example, when a user moves handle 116, system 100 may cause one or more valves to be actuated such that fluid flows past a valve cartridge associated with handle 116 and toward both of outlets 110 and 112; in some embodiments, additional downstream valves associated with the outlets may then be operable (e.g., in connection with an angular orientation of faucet head 108) to permit or to disallow flow of fluid all the way to a respective one of outlets 110 and 112.

In some embodiments, moving handle 116 to an open position may only cause one or more valves to be opened to allow flow to an outlet of the faucet if faucet head 108 is oriented in such a manner that the outlet is selected for use. For example, in some embodiments, handle 116 may send a signal to an electronic valve controlling a conduit leading to an outlet of system 100 to indicate that the handle is in an open position, but the same valve may also receive a signal from a sensor associated with the faucet head and configured to determine an orientation or position of the faucet head. In some embodiments, the electronic valve may only be opened when the system determines that the handle is in the open position and that faucet head 108 is in an orientation or position indicating selection of the associated fluid outlet. Thus, in some embodiments, if the user leaves handle 116 in the open position and rotates faucet head 108 to toggle to the other opening, then the flow of fluid from the first outlet may automatically cease and the flow of fluid to the second outlet may automatically begin (due to the system closing one valve and opening another in response to the position of faucet head 108 being changed). It should be noted that, in some embodiments, the effect of being able to leave a faucet handle (e.g., handle 116) in an open position and use rotation of the faucet head (e.g., faucet head 108) to toggle between outlets may be achieved using one or more mechanical valves and/or using one or more electronic valves. For example, rotation of a faucet head may mechanically/physically open and close valves controlling flow of fluid to its outlets, or rotation of a faucet head may cause electronic control signals to be sent to cause opening/closing of electronic valves controlling flow of fluid to its outlets. In some embodiments, both physically-controlled and electronically-controlled valves may be used in conjunction with one another; for example, a single valve may be able to be controlled in either manner, and/or different valves of each type may be used at different parts of a faucet system, such as in series with one another controlling flow of fluid along the same fluid flow path.

As shown in FIG. 1, system 100 may in some embodiments comprise dial 114, which may be any dial or other suitable measured-fill control mechanism configured to allow a user to specify a specific amount of fluid to dispense from one or more of the outlets of system 100. While a conventional faucet control, such as a manual handle, may be configured such that a user must engage the control to activate fluid flow at a time the user desires and to deactivate fluid flow at a time the user desires, a measured-fill control mechanism may allow a user to designate a volume of fluid to be dispensed in order to cause a faucet to automatically activate and deactivate flow in an appropriate manner in order to dispense the indicated volume of fluid. For example, a user may indicate via a measured-fill control mechanism that 1 cup of fluid should be dispensed, and a faucet may be configured to automatically control one or more valves in order to activate and deactivate the flow of fluid in order to cause exactly 1 cup to be dispensed. In some embodiments, a measured-fill control mechanism may be a physical mechanism such as a spring-controlled timer device (e.g., egg-timer style device) configured to cause a valve to close as the timer expires. In some embodiments, a measured-fill control mechanism may be a microprocessor-controlled electronic mechanism that sends control signals to one or more valves based on input detected from a user; a measured-fill control mechanism may accept inputs from a user via any suitable electronic input device, such as a knob, dial, lever, key-pad, button, touch-pad, touch-screen, voice-detector, motion-detector, mouse, keyboard, or the like.

In some embodiments of system 100, operation of a measured-fill control mechanism such as dial 114 may control one or more valves and allow or disallow flow of fluid to one or more of the openings of faucet head 108 in any same or similar manner as discussed above regarding control of valves of system 100. For example, operation of dial 114 may cause manual opening of a valve associated with one or more of outlets 110 and 112, such as a valve located downstream of a valve controlled by handle 116. In some embodiments, operation of dial 114 may cause electronic opening of a valve that is independently controlled by operation of dial 114, or alternately that is jointly controlled both by operation of dial 114 and/or by operation of handle 116. In some embodiments, dial 114 may only function when handle 116 is in an open position, while in some embodiments dial 114 may operate to cause the dispensation of fluid regardless of the position of handle 116.

In the example of system 100, dial 114 is a measured-fill control mechanism disposed on faucet head 108 near filtered water outlet 112, and configured to control the flow of filtered water from outlet 112. In the example shown, dial 114 is annular and is disposed on one end of faucet head 108, surrounding outlet 112. In some embodiments, dial 114 may be configured to rotate in a plane that is perpendicular to a plane in which faucet head 108 rotates. While the example of system 100 shows only one dial 114, some systems may include two or more measured-fill control mechanisms, such as another measured-fill dial disposed on the opposite end of faucet head 108 and configured to control flow of fluid to outlet 110.

Thus, as explained above with reference to FIG. 1, system 100 may be a dual-outlet faucet system having faucet head 108 with two fluid outlets. A user may manually rotate the position of faucet head 108 to select between a first mode in which fluid may be dispensed from outlet 110 and a second mode in which fluid may be dispensed from outlet 112. In order to control the flow of fluid from whichever outlet is selected, a user may operate handle 116 and/or may operate measured-fill dial 114.

Figure 2A:
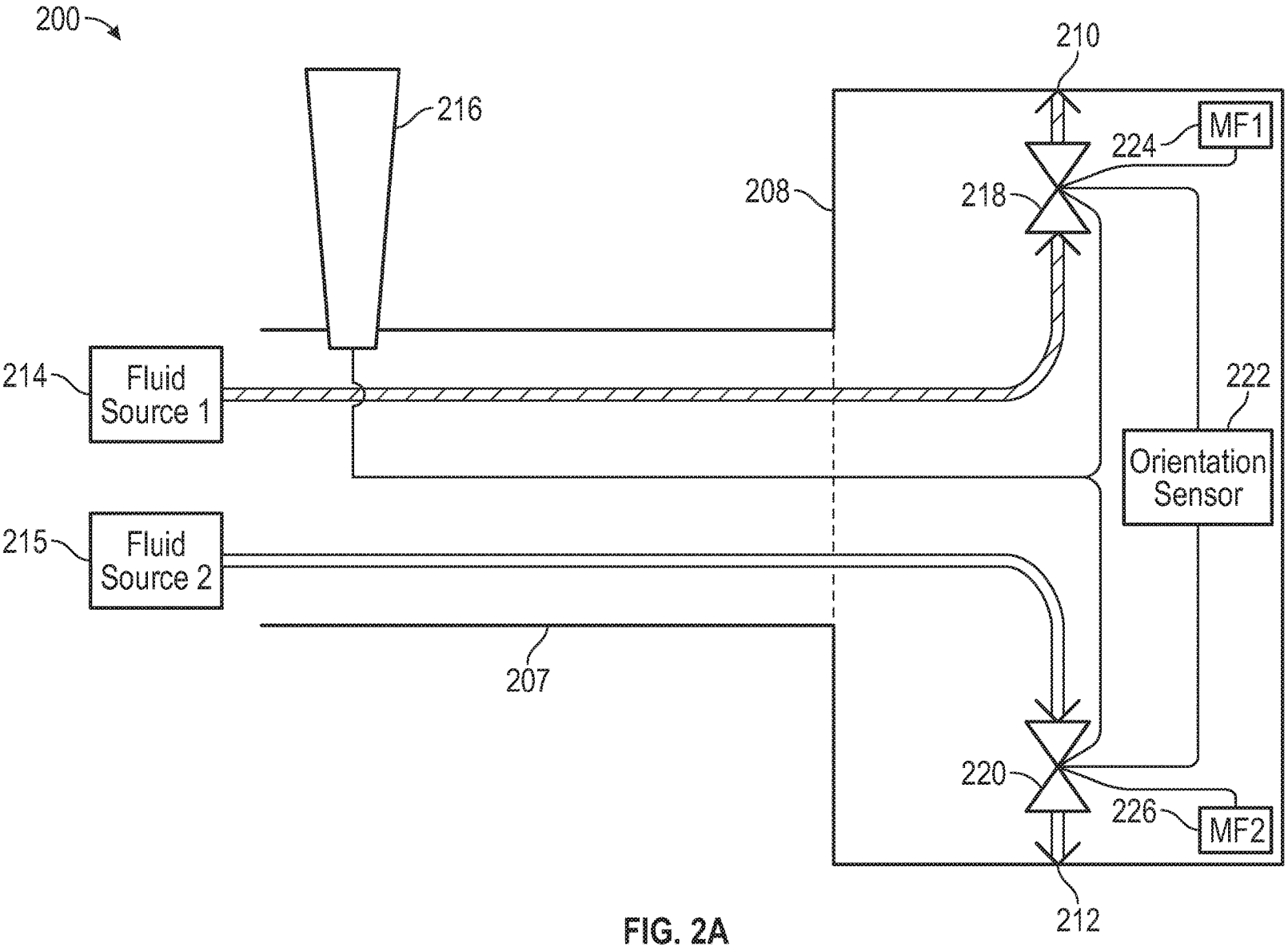
FIG. 2A and FIG. 2B show a schematic illustration of a multi-outlet faucet system, in accordance with some embodiments.
Figure 2B:
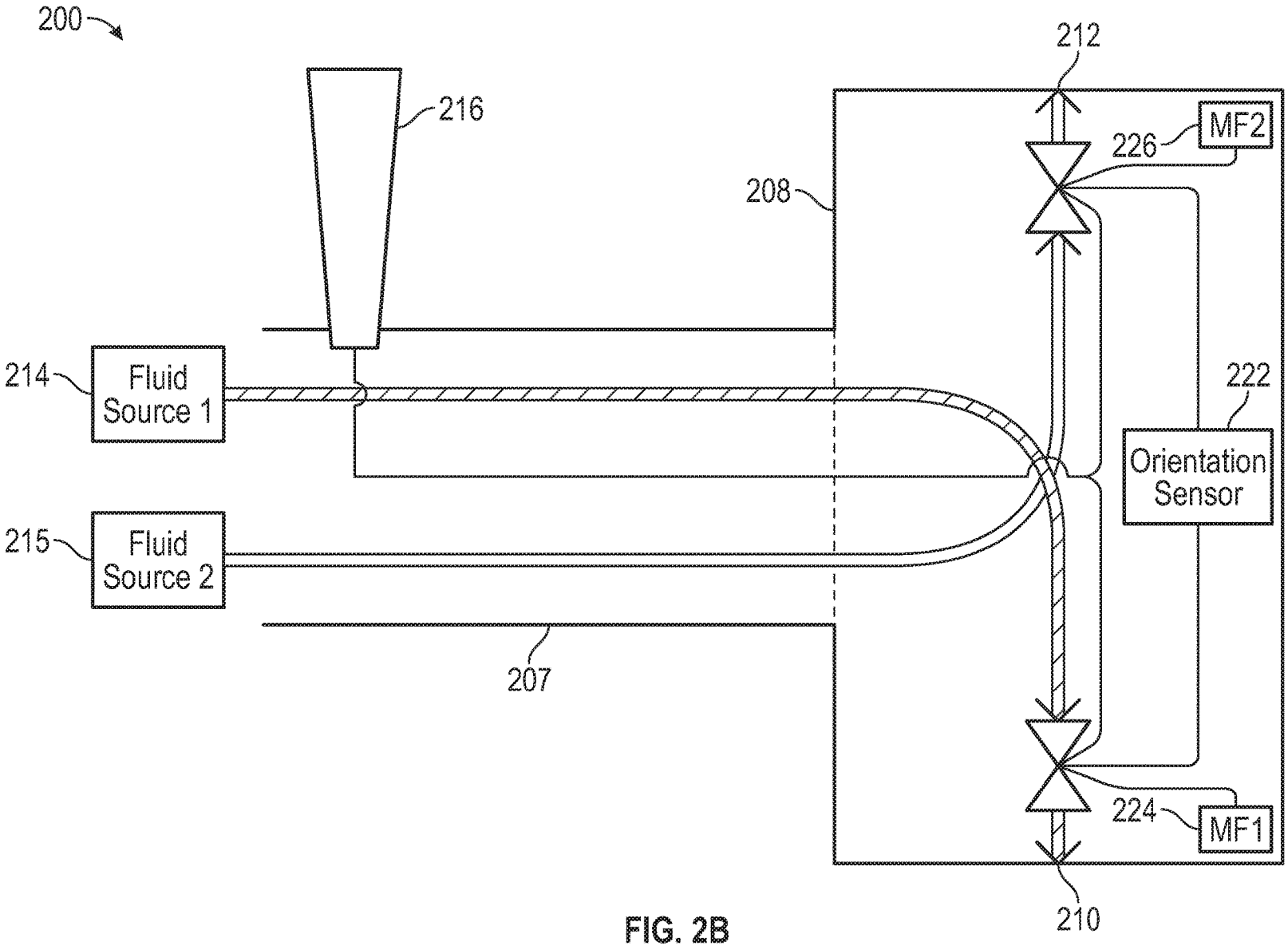

FIG. 2A and FIG. 2B show a schematic illustration of multi-outlet faucet system 200, in accordance with some embodiments. FIG. 2A illustrates system 200 in a first orientation for dispensation of water out of outlet 212, and FIG. 2B illustrates system 200 in a second orientation, with faucet head 208 rotated by 180 degrees about neck 207, for dispensation of water out of outlet 210. In some embodiments, multi-outlet faucet system 200 may share any one or more characteristics in common with system 100 as discussed above.

As shown in FIG. 2A, system 200 may comprise neck 207 and faucet head 208, which may share some or all characteristics in common with neck 107 and faucet head 108, respectively, as discussed above with respect to FIG. 1. Faucet head 208 may comprise first outlet 210 on one end and second outlet 212 on its opposite end; outlets 210 and 212 may share some or all characteristics in common with outlets 110 and 112, respectively, as discussed above with respect to FIG. 1.

System 200 may further comprise first fluid source 214 and second fluid source 215. The fluid sources of system 200 may be any of the types of fluid sources for dispensing any of the types of fluid discussed above with respect to FIG. 1. As shown, fluid source 214 may be fluidly connected to outlet 210 to provide fluid to be dispensed from outlet 210, and fluid source 215 may be fluidly connected to outlet 212 to provide fluid to be dispensed from outlet 212. In some embodiments, flow of fluid from fluid source 214 to outlet 210 may be controlled by valve 218, which may be an electronic valve (e.g., a solenoid valve) that may be remotely opened and closed in accordance with receiving electronic control signals. Valve 218 may comprise one or more microprocessor-based controllers configured to receive and interpret electronic signals and to apply those signals to control the valve to open and close it. Similarly, in some embodiments, flow of fluid from fluid source 215 to outlet 212 may be controlled by valve 220, which may share any one or more characteristics in common with valve 218. In some embodiments, system 200 may include additional valves for controlling flow from one or both of fluid sources 214 and 215 to their respective fluid outlets, but the example of FIG. 2A and FIG. 2B may utilize only the two valves shown to control flow from each fluid source to its respective outlet. Additional (or alternate) valves included in system 200 may be electronically-controllable and/or physically/manually controllable valves, and may be situated in parallel and/or in series with any of the valves shown in the exemplary embodiment.

As shown in FIG. 2A, each of valves 218 and 220 may be communicatively electronically coupled to one or more control systems, which may be any suitable electronic control system, such as a microprocessor-based system, configured to send control signals to the one or more of the valves to cause the one or more valves to open and/or close.

In the example of FIG. 2A, valves 218 and 220 are each communicatively coupled to handle 216, which may share any one or more characteristics in common with handle 116 as discussed above with respect to FIG. 1. In some embodiments, one or more sensors and/or microprocessor devices associated with handle 216 may be configured to detect a position of handle 216 in order to determine whether it is in an open position or a closed position, and to send electronic signals accordingly to one or more of valves 218 and 220, wherein the signals may be configured to cause the valves to open and/or close in accordance with the position of handle 216.

In the example of FIG. 2A, valves 218 and 220 are each further communicatively coupled to orientation sensor 222, which may be any one or more sensors and/or microprocessor devices configured to determine an orientation or position of faucet head 208. In some embodiments, orientation sensor 222 may comprise a gyroscope, IR sensor, magnetic sensor, optical sensor, or any other suitable sensor or sensors configured to determine an orientation and/or position of faucet head 208 with respect to neck 207 or with respect to a faucet body or an associated sink of system 200. Orientation sensor 222 may be further configured to send electronic signals to one or more of valves 218 and 220, wherein the signals may be configured to cause the valves to open and/or close in accordance with the determined orientation or position of faucet head 208. For example, in a similar manner as discussed above with respect to FIG. 1, orientation sensor 222 may be configured to determine a rotational orientation of faucet head 208, such that only a downward-facing fluid opening may be permitted to dispense fluid. In some embodiments, if sensor 222 determines that faucet head 208 is in an orientation in which a particular sensor is not facing downward, then sensor 222 may be configured to generate and send an electronic signal to close (or keep closed) a valve associated with the non-downward-facing outlet; in some embodiments, the valve may be closed regardless of a position of handle 216. For example, in the example of FIG. 2A, sensor 222 may send a signal to valve 218 causing valve 218 to be closed (or to remain closed) even if handle 216 is in an open position. In this way, the position of faucet head 208 may override the position of handle 216 such that a user may toggle between fluid sources by rotating faucet head 208 while leaving handle 216 in the open position, and fluid will only be dispensed from one outlet (whichever is downward-facing) at a time.

In the example of FIG. 2A, valves 218 and 220 are further communicatively coupled to measured-fill sensors 224 and 226, respectively. The example of FIG. 2A shows two measured-fill sensors; however, in some embodiments, only one measured-fill sensor, corresponding to a specific one or to both of outlets 210 and 212, may be included in system 200. Measured-fill sensors 224 and 226 may each be a microprocessor-based electronic sensor configured to detect user inputs to a measured-fill control mechanism (such as dial 114 in system 100). Measured-fill sensors 224 and 226 may be further configured to send electronic signals to an associated one (or more) of valves 218 and 220, wherein the signals may be configured to cause the associated valve(s) to open and/or close in accordance with the detected user inputs.

For example, in an embodiment in which sensor 226 is associated with a dial such as dial 114, sensor 226 may detect a user input in the form of a user rotating dial 114 to indicate dispensation of a certain amount of fluid in accordance with a degree of rotation of the dial, and sensor 226 may accordingly cause a signal to be generated and transmitted to valve 220 to cause valve 220 to be opened and closed in such a manner (e.g., at a determined time and to a determined degree to achieve a desired fluid throughput) so as to dispense the indicated volume of fluid from outlet 212.

As with control signals sent in accordance with a position of handle 216, control signals sent in accordance with inputs detected by sensors 224 and/or 226 may, in some embodiments, be overridden by an indication from orientation sensor 222 that a fluid outlet is not in a suitable (e.g., downward-facing) position for fluid dispensation. Thus, in some embodiments, a valve may stay in a closed position even if a user uses a measured-fill control mechanism to direct the valve to open if the outlet associated with the valve is not in a suitable fluid-dispensing (e.g., downward-facing) orientation at the time that the input is detected.

Thus, in some embodiments, an electronic valve (e.g., a solenoid valve) controlling flow of fluid to a fluid outlet of faucet head 208 may be configured to accept control signals from a handle, an orientation sensor, and/or a measured-fill sensor. In some embodiments, signals sent in accordance with a position of the handle and/or in accordance with an input detected by the measured-fill sensor may cause the valve to open to allow flow of fluid to the associated outlet. However, in some embodiments, opening the valve may further require that the valve receive a signal from the orientation sensor confirming that faucet head 208 is in a suitable position and/or orientation for fluid to be dispensed from the valve, such as by being oriented such that the outlet is in a downward-facing position.

In the example of FIG. 2A and FIG. 2B, FIG. 2A shows an orientation in which system 200 may dispense fluid from fluid source 215 through downward-facing outlet 212, while FIG. 2B shows an orientation in which faucet head 208 has been rotated 180 degrees from its position in FIG. 2A such that system 200 may dispense fluid from fluid source 214 through downward-facing outlet 210.

While the examples of FIG. 2A and FIG. 2B have been discussed with regard to electronically-controlled valves, it should be noted that physically/manually-controlled valves may alternately or additionally be used in systems such as system 200. For example, multiple valves in series on the same fluid conduit may be used to configure a faucet such that flow of fluid to a single outlet requires both a handle (or other control mechanism) to be set to an open position and a faucet head to be in a predetermined position, such as with the outlet facing downward.

Furthermore, in some embodiments, a position of a faucet head may serve as an independently sufficient control mechanism for activating and deactivating a faucet outlet, such that flow of fluid to one or more outlets may automatically be activated or deactivated in accordance with a position of the faucet head and without regard to a position of a handle, knob, or other additional control mechanism. For example, in some embodiments of system 100, a user may control flow of water to tap water outlet 110 by handle 116 and by the position of faucet head 108, whereas the flow of water to filtered-water outlet 112 may be controlled solely by the position of faucet head 108 (for example by always turning on the flow of water to outlet 112 when outlet 112 is in a downward-facing position).

Figure 3:
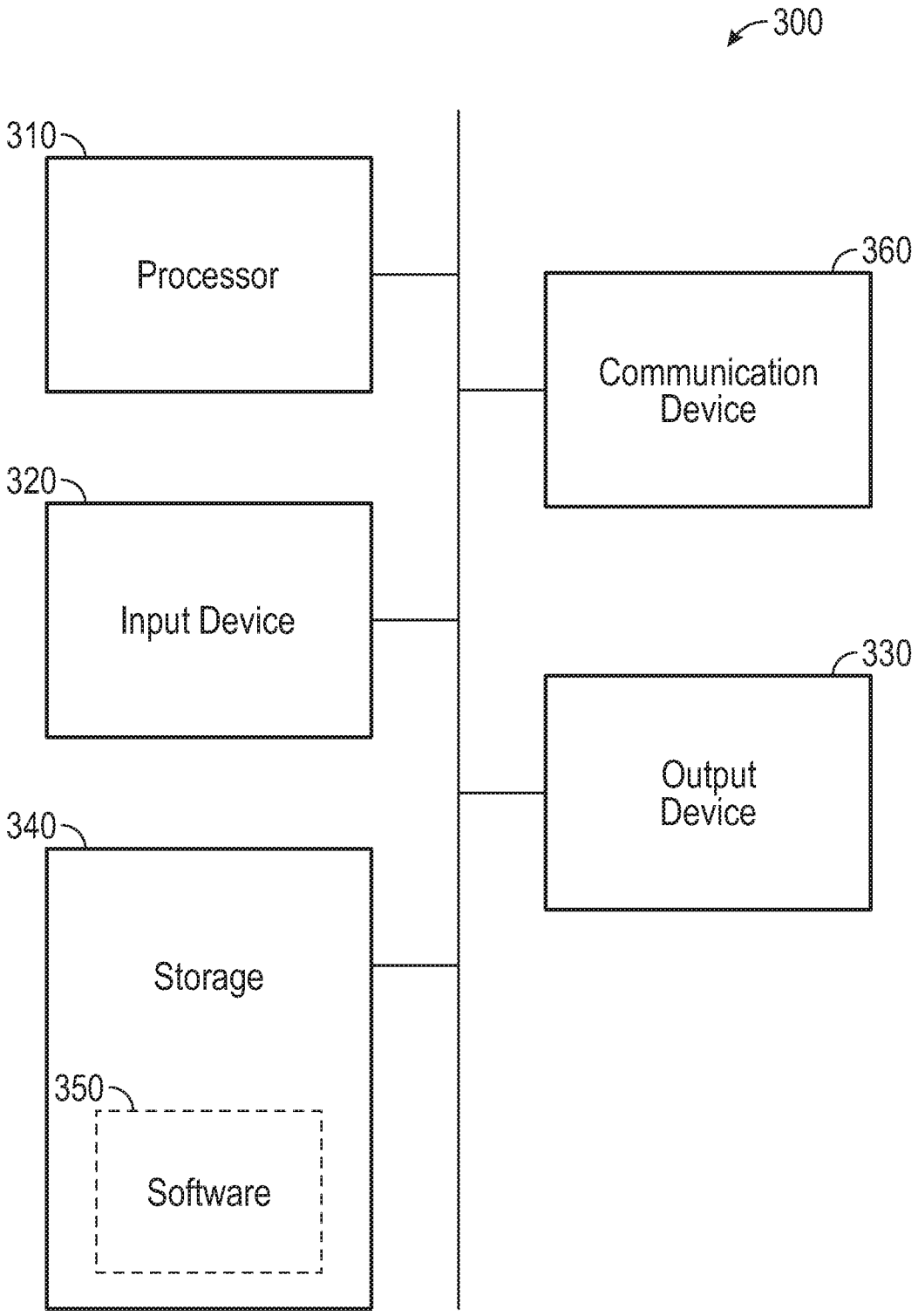
FIG. 3 shows a schematic illustration of a computer, in accordance with some embodiments.

FIG. 3 shows a schematic illustration of computer 300, in accordance with some embodiments. Computer 300 can be a component of a chip or other system for capillary electrophoresis and/or single-particle velocimetry-based identification and/or separation. In some embodiments, computer 300 is configured to execute a method for controlling one or more electronic components of a multi-outlet faucet system, such as any of the systems discussed above.

Computer 300 can be a host computer connected to a network. Computer 300 can be a client computer or a server. As shown in FIG. 3, computer 300 can be any suitable type of microprocessor-based device, such as a personal computer, workstation, server, or handheld computing device, such as a phone or tablet. The computer can include, for example, one or more of processor 310, input device 320, output device 330, storage 340, and communication device 360.

Input device 320 can be any suitable device that provides input, such as a touch screen or monitor, keyboard, mouse, or voice-recognition device. Output device 330 can be any suitable device that provides output, such as a touch screen, monitor, printer, disk drive, or speaker.

Storage 340 can be any suitable device that provides storage, such as an electrical, magnetic, or optical memory, including a RAM, cache, hard drive, CD-ROM drive, tape drive, or removable storage disk. Communication device 360 can include any suitable device capable of transmitting and receiving signals over a network, such as a network interface chip or card. The components of the computer can be connected in any suitable manner, such as via a physical bus or wirelessly. Storage 340 can be a non-transitory computer-readable storage medium comprising one or more programs, which, when executed by one or more processors, such as processor 310, cause the one or more processors to execute methods or techniques described herein, such as methods or techniques for automated control of any one or more of the systems and/or devices described herein.

Software 350, which can be stored in storage 340 and executed by processor 310, can include, for example, the programming that embodies the functionality of the present disclosure (e.g., as embodied in the systems, computers, servers, and/or devices as described above). In some embodiments, software 350 can include a combination of servers such as application servers and database servers.

Software 350 can also be stored and/or transported within any computer-readable storage medium for use by or in connection with an instruction execution system, apparatus, or device, such as those described above, that can fetch and execute instructions associated with the software from the instruction execution system, apparatus, or device. In the context of this disclosure, a computer-readable storage medium can be any medium, such as storage 340, that can contain or store programming for use by or in connection with an instruction execution system, apparatus, or device.

Software 350 can also be propagated within any transport medium for use by or in connection with an instruction execution system, apparatus, or device, such as those described above, that can fetch and execute instructions associated with the software from the instruction execution system, apparatus, or device. In the context of this disclosure, a transport medium can be any medium that can communicate, propagate, or transport programming for use by or in connection with an instruction execution system, apparatus, or device. The transport-readable medium can include, but is not limited to, an electronic, magnetic, optical, electromagnetic, or infrared wired or wireless propagation medium.

Computer 300 may be connected to a network, which can be any suitable type of interconnected communication system. The network can implement any suitable communications protocol and can be secured by any suitable security protocol. The network can comprise network links of any suitable arrangement that can implement the transmission and reception of network signals, such as wireless network connections, T1 or T3 lines, cable networks, DSL, or telephone lines.

Computer 300 can implement any operating system suitable for operating on the network. Software 350 can be written in any suitable programming language, such as C, C++, Java, or Python. In various embodiments, application software embodying the functionality of the present disclosure can be deployed in different configurations, such as in a client/server arrangement or through a Web browser as a Web-based application or Web service, for example.

Some embodiments of the invention include the following.

In a first embodiment, disclosed is a faucet comprising a faucet body; a faucet head comprising a first fluid outlet and a second fluid outlet; and one or more valves configured to control flow of fluid to one or more of the first fluid outlet and the second fluid outlet; wherein, the faucet head is configured to be movable between a first position and a second position with respect to the faucet body; and when the faucet head is in the first position, the one or more valves permit flow to the first fluid outlet and do not permit flow to the second fluid outlet; and when the faucet head is in the second position, the one or more valves permit flow to the second fluid outlet and do not permit flow to the first fluid outlet.

In a second embodiment, disclosed is a faucet according to the first embodiment, wherein the one or more valves comprise a first valve controlling flow of fluid to the first fluid outlet and a second valve controlling flow of fluid to the second fluid outlet. In a third embodiment, disclosed is a faucet of the first or second embodiments, wherein the one or more valves comprises a valve controlling flow of fluid to both the first and second outlet.

In a fourth embodiment, disclosed is a faucet according to any of the preceding embodiments, wherein the first fluid outlet is configured to dispense a first fluid from a first fluid source and the second fluid outlet is configured to dispense a second fluid from a second fluid source. In a fifth embodiment, disclosed is a faucet according to any of the preceding embodiments, wherein the first fluid is unfiltered water and the second fluid is filtered water.

In a sixth embodiment, disclosed is a faucet according to any of the preceding embodiments, wherein one or more of the one or more valves are disposed inside the faucet head. In a seventh embodiment, disclosed is a faucet according to any of the preceding embodiments, wherein one or more of the one or more valves are disposed at a location fluidly connected to the faucet head and outside the faucet head.

In an eighth embodiment, disclosed is a faucet according to any of the preceding embodiments, wherein the first position is a first angular orientation with respect to the faucet body; the second position is a second angular orientation with respect to the faucet body; and the faucet head being configured to be movable between the first position and the second position comprises the faucet head being configured to be rotatable with respect to the faucet body between the first angular orientation and the second angular orientation.

In a ninth embodiment, disclosed is a faucet according to any of the preceding embodiments, wherein the faucet head is physically coupled to one or more of the one or more valves such that moving the faucet head to the first position causes the one or more valves to be manually opened to permit flow to the first fluid outlet and to prevent flow to the second fluid outlet.

In a tenth embodiment, disclosed is a faucet according to any of the preceding embodiments, wherein the faucet head is physically coupled to one or more of the one or more valves such that moving the faucet head to the second position causes the one or more valves to be manually opened to permit flow to the second fluid outlet and to prevent flow to the first fluid outlet.

In an eleventh embodiment, disclosed is a faucet according to any of the preceding embodiments, wherein the faucet head is electronically communicatively coupled to one or more of the one or more valves such that moving the faucet head to the first position causes a control signal to be sent to the one or more valves to cause the one or more valves to be electronically opened to permit flow to the first fluid outlet and to prevent flow to the second fluid outlet.

In a twelfth embodiment, disclosed is a faucet according to any of the preceding embodiments, wherein the faucet head is electronically communicatively coupled to one or more of the one or more valves such that moving the faucet head to the second position causes a control signal to be sent to the one or more valves to cause the one or more valves to be electronically opened to permit flow to the second fluid outlet and to prevent flow to the first fluid outlet.

In a thirteenth embodiment, disclosed is a faucet according to any of the preceding embodiments, wherein the first fluid outlet is facing downward toward a sink when the faucet head is in the first position. In a fourteenth embodiment, disclosed is a faucet according to any of the preceding embodiments, wherein the second fluid outlet is facing downward toward a sink when the faucet head is in the second position. In a fifteenth embodiment, disclosed is a faucet according to any of the preceding embodiments, further comprising a handle configured to control flow of fluid to one or more of the first fluid outlet and the second fluid outlet.

In a sixteenth embodiment, disclosed is a faucet according to any of the preceding embodiments, further comprising a measured-fill control mechanism configured to cause flow of fluid to one or more of the first outlet and the second outlet to start and stop in accordance with a predetermined time interval in order to dispense a target volume of fluid. In a seventeenth embodiment, disclosed is a faucet according to any of the preceding embodiments, wherein the first fluid outlet is disposed on a first side of the faucet head and the second fluid outlet is disposed on a second side of the faucet head opposite the first side.

In an eighteenth embodiment, disclosed is a faucet according to any of the preceding embodiments, wherein when the faucet head is in the first position, the first fluid outlet is facing in a first direction; and when the faucet head is in the second position, the first fluid outlet is facing in a second direction opposite the first direction.

In a nineteenth embodiment, disclosed is a faucet according to any of the preceding embodiments, wherein when the faucet head is in the first position, the first fluid outlet is located in a first location and oriented in a first orientation with respect to the faucet body; and when the faucet head is in the second position, the second fluid outlet is located in the first location and oriented in the first orientation with respect to the faucet body.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

The articles "a" and "an" herein refer to one or to more than one (e.g. at least one) of the grammatical object.

The invention claimed is:

1. A faucet comprising a faucet body;

a faucet head comprising a first fluid outlet and a second fluid outlet; and one or more valves configured to control flow of fluid to one or more of the first fluid outlet and the second fluid outlet;

wherein, the faucet head is configured to be movable between a first position and a second position with respect to the faucet body; and when the faucet head is in the first position, the one or more valves permit flow to the first fluid outlet and do not permit flow to the second fluid outlet; and when the faucet head is in the second position, the one or more valves permit flow to the second fluid outlet and do not permit flow to the first fluid outlet.

2. The faucet of claim 1, wherein the one or more valves comprise a first valve controlling flow of fluid to the first fluid outlet and a second valve controlling flow of fluid to the second fluid outlet.

3. The faucet of claim 1, wherein the one or more valves comprises a valve controlling flow of fluid to both the first and second outlet.

4. The faucet of claim 1, wherein the first fluid outlet is configured to dispense a first fluid from a first fluid source and the second fluid outlet is configured to dispense a second fluid from a second fluid source.

5. The faucet of claim 4, wherein the first fluid is unfiltered water and the second fluid is filtered water.

6. The faucet of claim 1, wherein one or more of the one or more valves are disposed inside the faucet head.

7. The faucet of claim 1, wherein one or more of the one or more valves are disposed at a location fluidly connected to the faucet head and outside the faucet head.

8. The faucet of claim 1, wherein the first position is a first angular orientation with respect to the faucet body;

the second position is a second angular orientation with respect to the faucet body; and wherein the faucet head being configured to be movable between the first position and the second position comprises the faucet head being configured to be rotatable with respect to the faucet body between the first angular orientation and the second angular orientation.

9. The faucet of claim 1, wherein the faucet head is physically coupled to one or more of the one or more valves; such that moving the faucet head to the first position causes the one or more valves to be manually opened to permit flow to the first fluid outlet and to prevent flow to the second fluid outlet; and that moving the faucet head to the second position causes the one or more valves to be manually opened to permit flow to the second fluid outlet and to prevent flow to the first fluid outlet.

10. The faucet of claim 1, wherein the faucet head is electronically communicatively coupled to one or more of the one or more valves; such that moving the faucet head to the first position causes a control signal to be sent to the one or more valves to cause the one or more valves to be electronically opened to permit flow to the first fluid outlet and to prevent flow to the second fluid outlet; and that moving the faucet head to the second position causes a control signal to be sent to the one or more valves to cause the one or more valves to be electronically opened to permit flow to the second fluid outlet and to prevent flow to the first fluid outlet.

11. The faucet of claim 1, wherein the first fluid outlet is facing downward toward a sink when the faucet head is in the first position and/or wherein the second fluid outlet is facing downward toward a sink when the faucet head is in the second position.

12. The faucet of claim 1, further comprising a handle configured to control flow of fluid to one or more of the first fluid outlet and the second fluid outlet.

13. The faucet of claim 1, further comprising a measured-fill control mechanism configured to cause flow of fluid to one or more of the first outlet and the second outlet to start and stop in accordance with a predetermined time interval in order to dispense a target volume of fluid.

14. The faucet of claim 1, wherein when the faucet head is in the first position, the first fluid outlet is facing in a first direction; and when the faucet head is in the second position, the first fluid outlet is facing in a second direction opposite the first direction.

15. The faucet of claim 1, wherein when the faucet head is in the first position, the first fluid outlet is located in a first location and oriented in a first orientation with respect to the faucet body; and when the faucet head is in the second position, the second fluid outlet is located in the first location and oriented in the first orientation with respect to the faucet body.

* * * * *